US005839669A

United States Patent [19]

Börner et al.

[11] Patent Number: 5,839,669

[45] Date of Patent: Nov. 24, 1998

[54] METHOD AND APPARATUS FOR POWDER SPRAYING

[75] Inventors: Gunter Börner, Mühlhausen; Hans-Christoph Nienburg, Heidelberg; Helmut Böhme, Nussloch; Jörg Sopka, Schwetzingen; Wolfgang Kleber, Dresden, all of Germany

[73] Assignee: ABB Research Ltd, Zuerich, Switzerland

[21] Appl. No.: 726,815

[22] Filed: Oct. 7, 1996

[30] Foreign Application Priority Data

Oct. 5, 1995 [DE] Germany ..... 195 37 089.9

[51] Int. Cl.[6] ..... B05B 5/00

[52] U.S. Cl. ..... 239/704; 239/706; 239/708; 239/524; 406/136; 406/138

[58] Field of Search ..... 239/690, 704–8, 239/461, 518, 524; 406/136, 137, 138, 144, 146

[56] References Cited

U.S. PATENT DOCUMENTS

| | | | |
|---|---|---|---|
| 2,621,156 | 12/1952 | Farrell | 406/136 |
| 3,134,513 | 5/1964 | Ashman | 406/138 |
| 3,149,884 | 9/1964 | Jones | 406/138 |
| 3,237,805 | 3/1966 | Stogner | 406/144 |
| 3,496,413 | 2/1970 | Goodridge et al. | 239/704 |
| 3,786,309 | 1/1974 | Miottel | 239/706 |
| 4,586,854 | 5/1986 | Newman et al. | 406/138 |
| 4,596,497 | 6/1986 | Yamada et al. | 406/144 |
| 4,615,649 | 10/1986 | Sharpless | 406/138 |
| 4,640,310 | 2/1987 | Hartle et al. | 137/883 |
| 5,018,910 | 5/1991 | Weiss | 406/144 |

FOREIGN PATENT DOCUMENTS

| | | | |
|---|---|---|---|
| 967353 | 5/1975 | Canada | 239/706 |
| 2 581 324 | 11/1986 | France . | |
| 35 29 703 C1 | 8/1986 | Germany . | |
| 39 25 476 A1 | 3/1990 | Germany . | |
| 594633 | 6/1986 | U.S.S.R. | 239/704 |
| 94/13405 | 6/1994 | WIPO . | |

*Primary Examiner*—Andres Kashnikow
*Assistant Examiner*—Lisa Ann Douglas
*Attorney, Agent, or Firm*—Herbert L. Lerner; Laurence A. Greenberg

[57] ABSTRACT

A method and an apparatus for powder spraying can be used, for example, for electrostatic enameling. In order to achieve an easily regulatable high powder output rate, it is proposed to fluidize powder in a closed container, extract it in the region of the fluid bed and cause it to emerge through a nozzle on the container. The container is subdivided by a frit into a first chamber to which air is fed and a second chamber which contains the powder and out of which air is discharged through a valve. A powder output rate can be regulated by the regulation of air pressures.

7 Claims, 7 Drawing Sheets

METHOD AND APPARATUS FOR POWDER SPRAYING

BACKGROUND OF THE INVENTION

Field of the Invention

The invention relates to a method for the spraying of a fluidized powder, in which fluidizing takes place in a two-chamber apparatus having a first chamber into which compressed air is introduced and then fed to a second chamber through a frit. Fluidized powder emerges from the two-chamber apparatus and is subsequently charged electrically. The invention also relates to an apparatus for carrying out the method.

Such a method and an associated apparatus are known from German Published, Non-Prosecuted Patent Application DE 12 34 802 A and are used, for example, for electrostatic enameling. The known apparatus for powder spraying has a first chamber, into which additional compressed air is introduced and enters a second chamber through a frit (a porous separating wall). A powder suspended in air is fed to the second chamber through a conduit and is further swirled together with the additional compressed air emerging from the frit and conveyed in countercurrent. Electrical charging of the powder particles emerging from the second chamber is carried out through the use of electrodes which are disposed in the region of a powder/air outlet orifice, are connected to a high-voltage generator and form an electrostatic field.

According to one embodiment, the known apparatus also works with a third feed conduit which conveys air and which has an improving effect on the powder/air delivery in the powder/air outlet region. The powder/air outlet point is constantly opened and the spraying operation is controlled by controlling or regulating feed quantities of air and of the air/powder mixture.

Other apparatuses for powder spraying which, however, do not work with a two-chamber configuration of the type described above, are known from German Patent DE 35 29 703 C1 and Published European Patent Application 0 574 305 A1. The apparatus known from Published European Patent Application 0 574 305 A1 contains a rotating baffle body in the air/powder outlet region for improving the powder distribution.

What is common to all of the above-mentioned methods and apparatuses is that the work is carried out with a relatively large quantity of air for conveying and spraying the powder, and the powder output rate, powder-jet orientability and capacity for regulating the powder output are unsatisfactory.

SUMMARY OF THE INVENTION

It is accordingly an object of the invention to provide a method and an apparatus for powder spraying, which overcome the hereinafore-mentioned disadvantages of the heretofore-known methods and devices of this general type and with which an easily regulatable high output rate can be achieved and a powder jet can be oriented in a controlled manner.

With the foregoing and other objects in view there is provided, in accordance with the invention, a method for spraying a fluidized powder, which comprises introducing compressed air into a first chamber of a two-chamber fluidizing container being closed except for a nozzle, an air inlet and an air outlet; filling or introducing powder through a closable powder feed orifice into the second chamber; feeding the compressed air from the first chamber through a frit into a second chamber of the two-chamber fluidizing container forming a fluidized powder bed; maintaining suitable pressure conditions by regulating with valves in the air inlet and outlet; extracting the fluidized powder from the vicinity of the fluidized bed and feeding the fluidized powder to the nozzle; and electrically charging the fluidized powder emerging from the two-chamber container through the nozzle.

In accordance with another mode of the invention, there is provided a method which comprises additionally supplying mechanical energy to the fluidized bed in the second chamber by agitation or vibration for preventing relatively large air bubbles from forming, rising and reaching the nozzle.

With the objects of the invention in view there is also provided an apparatus for spraying a fluidized powder, comprising a closed container having a first chamber for receiving compressed air, a second chamber, and a frit disposed between the chambers for passing the compressed air out of the first chamber and into the second chamber; a regulator for compressed air supply and discharge; a closable powder feed orifice for introducing powder into the second chamber where the powder is fluidized into a fluidized bed by the compressed air from the first chamber; a powder outlet region and a closable nozzle at the powder outlet region for receiving the fluidized powder to be extracted from the vicinity of the fluidized bed; and high-voltage electrodes for charging at the powder outlet region.

In accordance with another feature of the invention, there is provided a baffle body disposed in the powder outlet region and a drive device for rotating the baffle body.

In accordance with a further feature of the invention, there is provided a rotating disc on which the high-voltage electrodes for electrostatic charging are disposed for achieving particularly uniform charging at a circumference of a powder cloud.

In accordance with an added feature of the invention, the container has an outer wall, and there is provided an annular earth electrode disposed between the outer wall and the high-voltage electrodes, at least some ion current flowing to the annular earth electrode to intersect a powder stream for improved charging.

In accordance with an additional feature of the invention, the container has a housing wall, and there is provided a pipe for extracting the fluidized powder from the fluidized bed, for conducting the fluidized powder to the nozzle and for preventing relatively large air bubbles rising on the housing wall from reaching the nozzle.

In accordance with a concomitant feature of the invention, there are provided air nozzles opening into the powder inlet region for conducting additional air, for additionally accelerating particles of the powder and for additionally forming a powder cloud.

In the method according to the invention, powder is fluidized in a closed container and a powder cloud having a relatively low air component emerges. The powder outlet rate can be advantageously determined by the regulation of easily measurable air pressures. There is no need for filling-level measurements. No powder losses occur during the switching-on or switching-off operation.

Other features which are considered as characteristic for the invention are set forth in the appended claims.

Although the invention is illustrated and described herein as embodied in a method and an apparatus for powder spraying, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
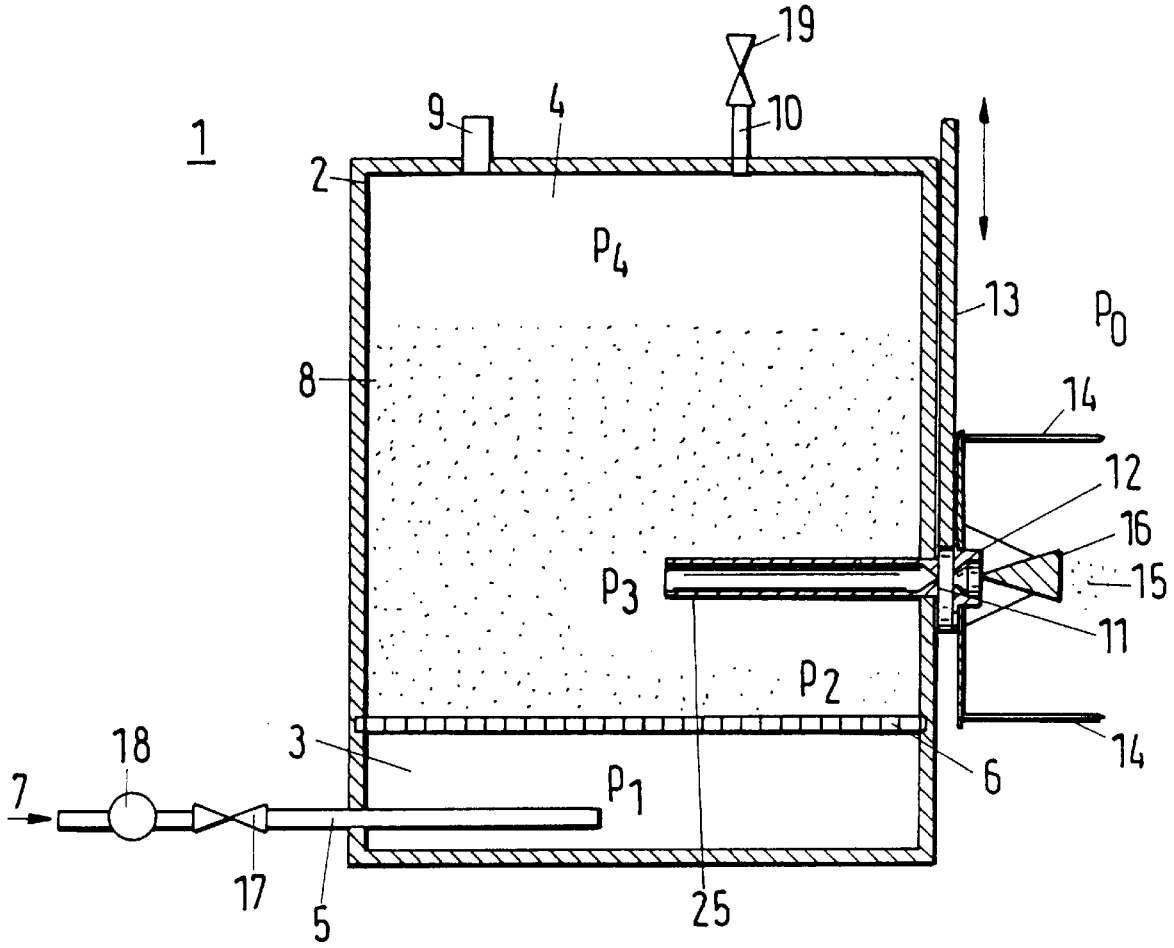
FIG. 1 is a diagrammatic, vertical-sectional view of a powder-spraying apparatus.

Referring now to the figures of the drawings in detail and first, particularly, to FIG. 1 thereof, there is seen a powder-spraying apparatus 1 which essentially includes a closed container 2 with a first chamber 3 and a second chamber 4. A compressed-air feed conduit 5 opens into the first chamber 3. Compressed air 7 passes through the feed conduit 5 and a frit 6 into the second chamber 4. Powder 8 which can be introduced through a powder feed orifice 9 is located in the second chamber 4.

The air 7, which is guided through the frit 6 into the powder 8 and fluidizes the latter to form a fluidized powder bed, can emerge again through an air outlet orifice 10 on the container 2 above the fluidized powder bed.

The fluidized powder 8 is extracted from the region of the fluidized bed through a pipe 25 and is led out through a nozzle 11 that is disposed laterally on the container 2 and is capable of being closed through the use of a closing device 13.

Needles which are connected to a non-illustrated high-voltage source and which cause the emerging powder particles to be charged, are disposed in a powder outlet region 12 as corona electrodes 14.

An emerging powder cloud 15 has a form which can be determined by the nozzle 11 and by additional baffle bodies 16, 22 (see also FIGS. 10 to 13. The form and configuration of the electrodes 14 can be adapted thereto.

The air feed can be influenced through the use of a controllable air inlet valve 17 and the air feed rate can be measured through the use of a flow-rate meter 18. The outlet orifice 10 for fluidizing air is closed off through the use of a controllable outlet valve 19, with the result that a specific flow resistance can be set. The valves 17 and 19 provide a regulator for compressed air supply and discharge.

An air pressure $p_1$ in the first chamber 3 and an air pressure $p_4$ above the powder 8 in the bed can be regulated by the valves 17 and 19 through the use of a non-illustrated control and regulating device. In this case, the pressures $p_1$ and $p_4$ are measured through the use of suitable pressure sensors. The ambient air pressure is designated by reference symbol $p_0$. The air pressure above the frit 6 and therefore immediately below the fluidized powder bed is designated by reference symbol $p_2$. A pressure drop $p_1-p_2$ is dependent on the selected frit 6 and must be taken into account during dimensioning.

A pressure within the container 2 at the powder outlet orifice 11 is designated by reference symbol $p_3$ and can be set by regulating the pressures $p_1$ and $p_4$.

The quantity of powder flowing out and the velocity of the particles during outflow are determined by a differential pressure $\Delta p=p_3-p_0$, by the structure of the nozzle 11, that is to say by its flow resistance, by the parameters of the powder and by the fluidizing state.

Since irregularities that are caused by bubbles, for example, cannot be avoided on the walls of the chamber during fluidizing, the powder is tapped from inside the chamber 4 through the pipe 25 attached to the nozzle 11. This guarantees a high uniformity of the powder output.

Since only pressures and an air flow rate have to be measured and regulated (but not filling levels), the powder output rate can be set and regulated very easily. High output rates in the range of 100 g/min to 1000 g/min can be achieved. The regulating behavior of the apparatus is very good, since fluidizing and spraying take place in a single apparatus. Since there is no hose connection between the fluidizing chamber 4 and nozzle 11, no fluctuations in the powder output and no powder losses occur during switching-on and switching-off.

Fluidizing can advantageously be carried out near a loosening or aerating point where an air/powder ratio of the sprayed powder is then at its minimum. Moreover, high uniformity of the powder output is thereby guaranteed.

Figure 2:
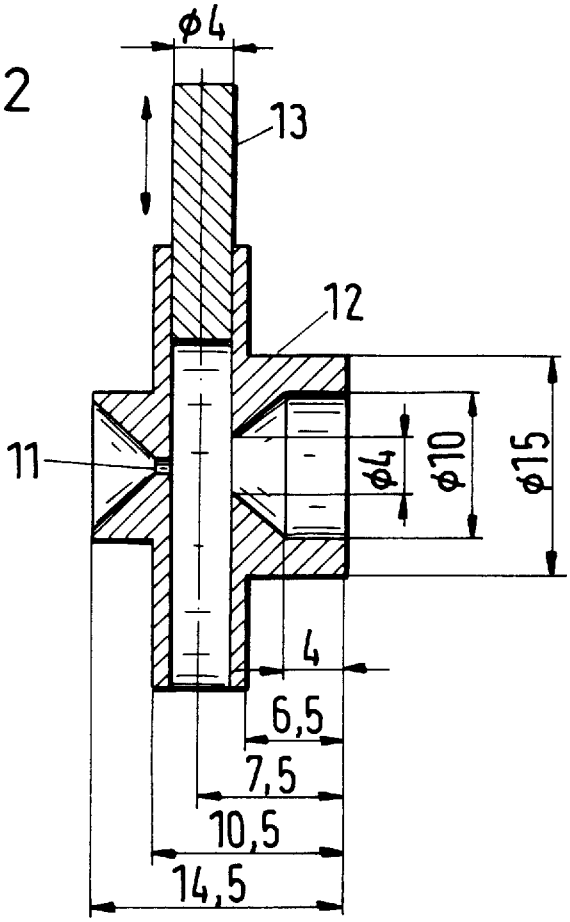
FIG. 2 is an enlarged, vertical-sectional view of a powder outlet nozzle.
Figure 3:
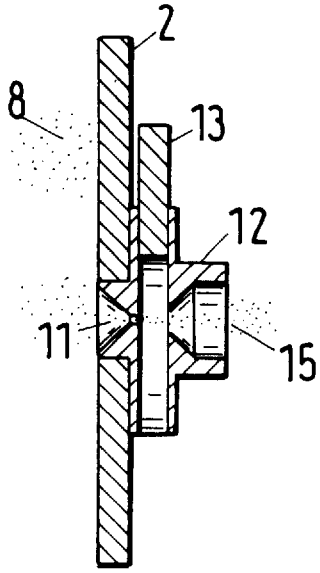
FIG. 3 is a vertical-sectional view of a spraying apparatus with the nozzle opened.
Figure 4:
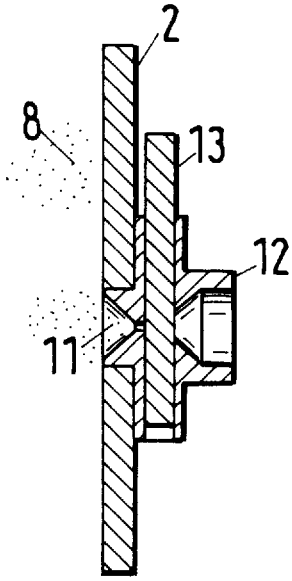
FIG. 4 is a view similar to FIG. 3 of a spraying apparatus with the nozzle closed.

The form of the powder cloud 15 can be influenced, inter alia, by the form of the nozzle 11 and of the powder outlet region 12. FIG. 2 specifies a possible structure of the nozzle 11 and of the outlet region 12 with dimensions in millimeters given by way of example. FIGS. 3 and 4 show details of the powder-spraying apparatus 1, with the nozzle 11 shown in FIG. 2 being represented with the closing device 13 in the open and the closed position, respectively.

Figure 5:
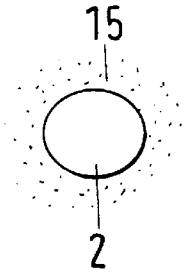
FIGS. 5 to 7 are top-plan views of containers with various forms of powder clouds.
Figure 6:
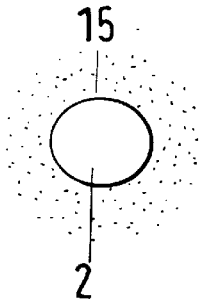
Figure 7:
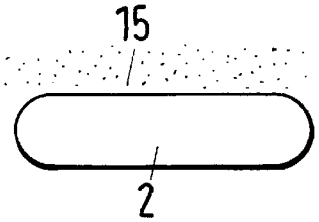

FIG. 5 shows a top view of a typical cylindrical container 2 with an emerging powder cloud 15. However, through the use of an appropriate construction of the nozzle 11 and the outlet region 12, another shape of the powder cloud 15 can also be achieved, as is shown in FIG. 6. FIG. 7 shows that the structure of the container 2 can also be adapted to a desired form of the cloud 15.

Figure 8:
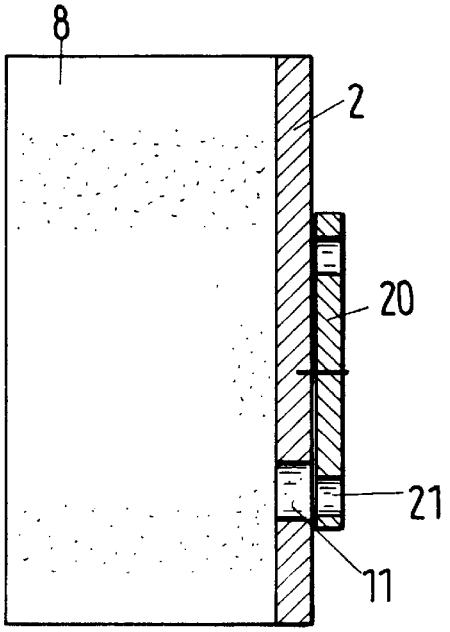
FIGS. 8 and 9 are respective vertical-sectional and side-elevational views of a spraying apparatus with an alternative nozzle construction.
Figure 9:
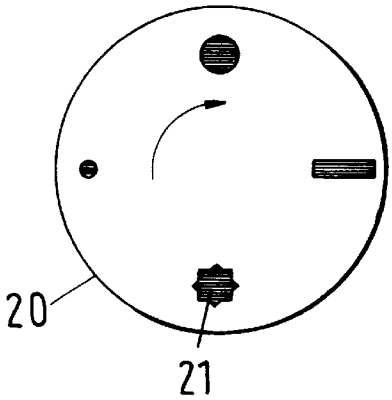

A simple possibility for the construction of the nozzle is shown in FIGS. 8 and 9, in which a diaphragm 20 with different nozzle orifices 21 is represented.

Figure 10:
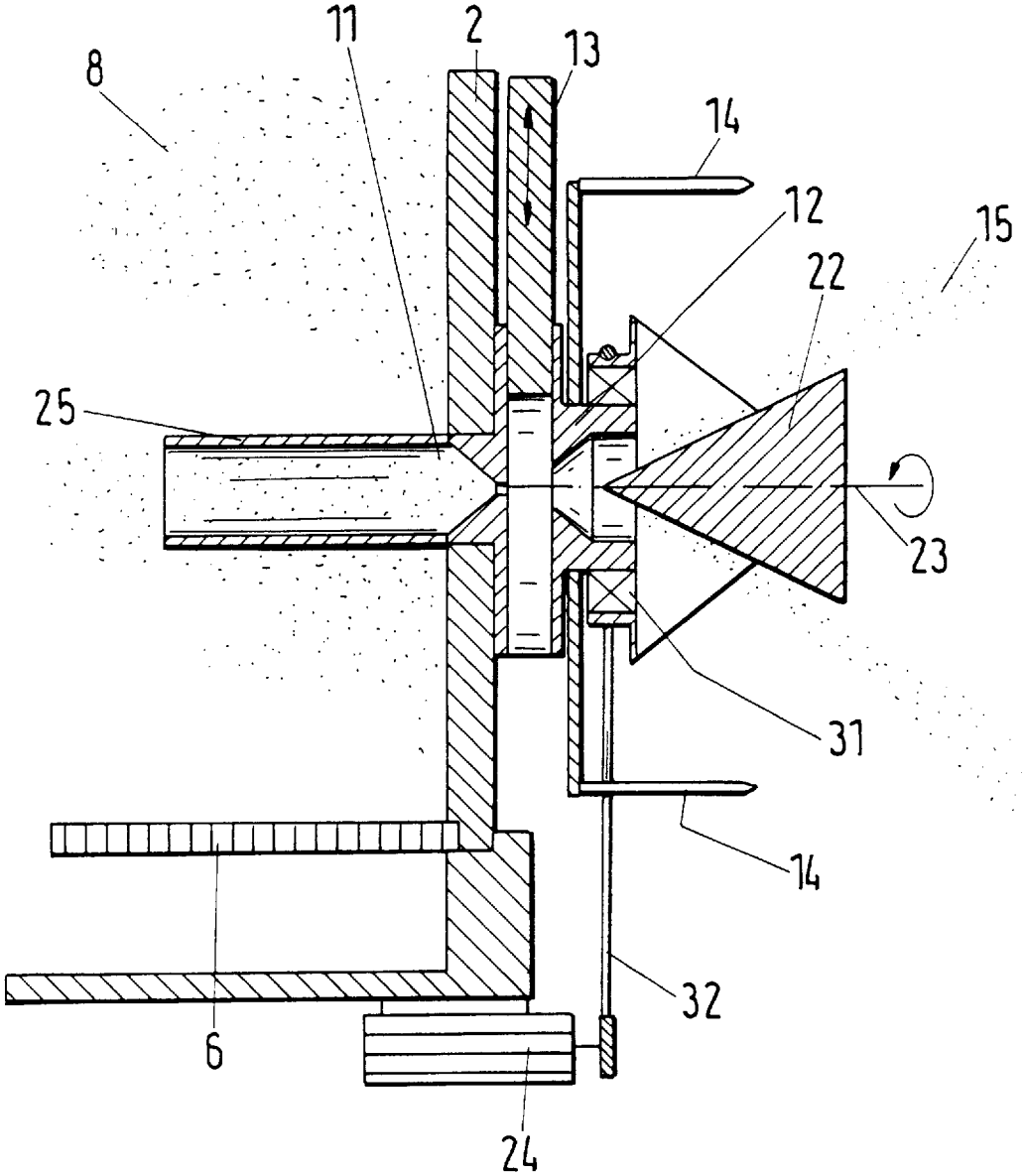
FIGS. 10 and 11 are vertical-sectional views of a spraying apparatus with a rotating baffle body.
Figure 11:
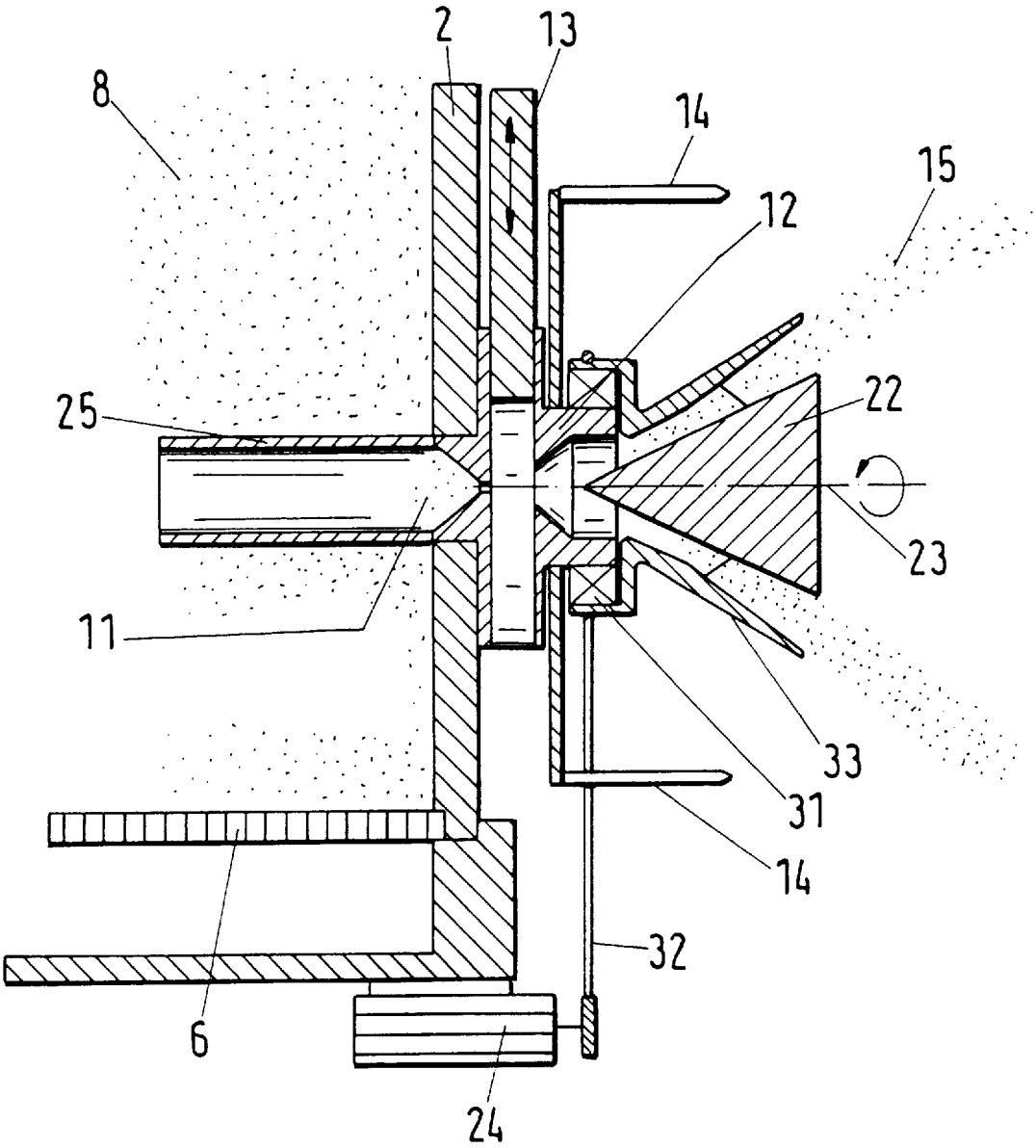

A particularly wide and uniform powder cloud can also be achieved through the use of a baffle body (deflector) which, as is shown diagrammatically in FIGS. 10 and 11, can also be constructed as the baffle body 22 that rotates about an axis 23. An associated drive device 24, including a ball bearing 31 and a drive belt 32 for the rotating baffle body 22 is diagrammatically indicated in the drawing. FIGS. 10 and 11 show different constructions of the powder outlet region 12. In FIG. 11, a casing 33 is also placed around the baffle body 22, so as to produce a rotating gap, through the use of which the form of the powder cloud can additionally be influenced.

The spraying apparatus 1 according to FIG. 1 can be operated in such a way that powder 8 is introduced and the filling orifice 9 is then closed. The powder can subsequently be sprayed until a minimum powder level, which is located in the region of the nozzle 11, is reached.

Figure 12:
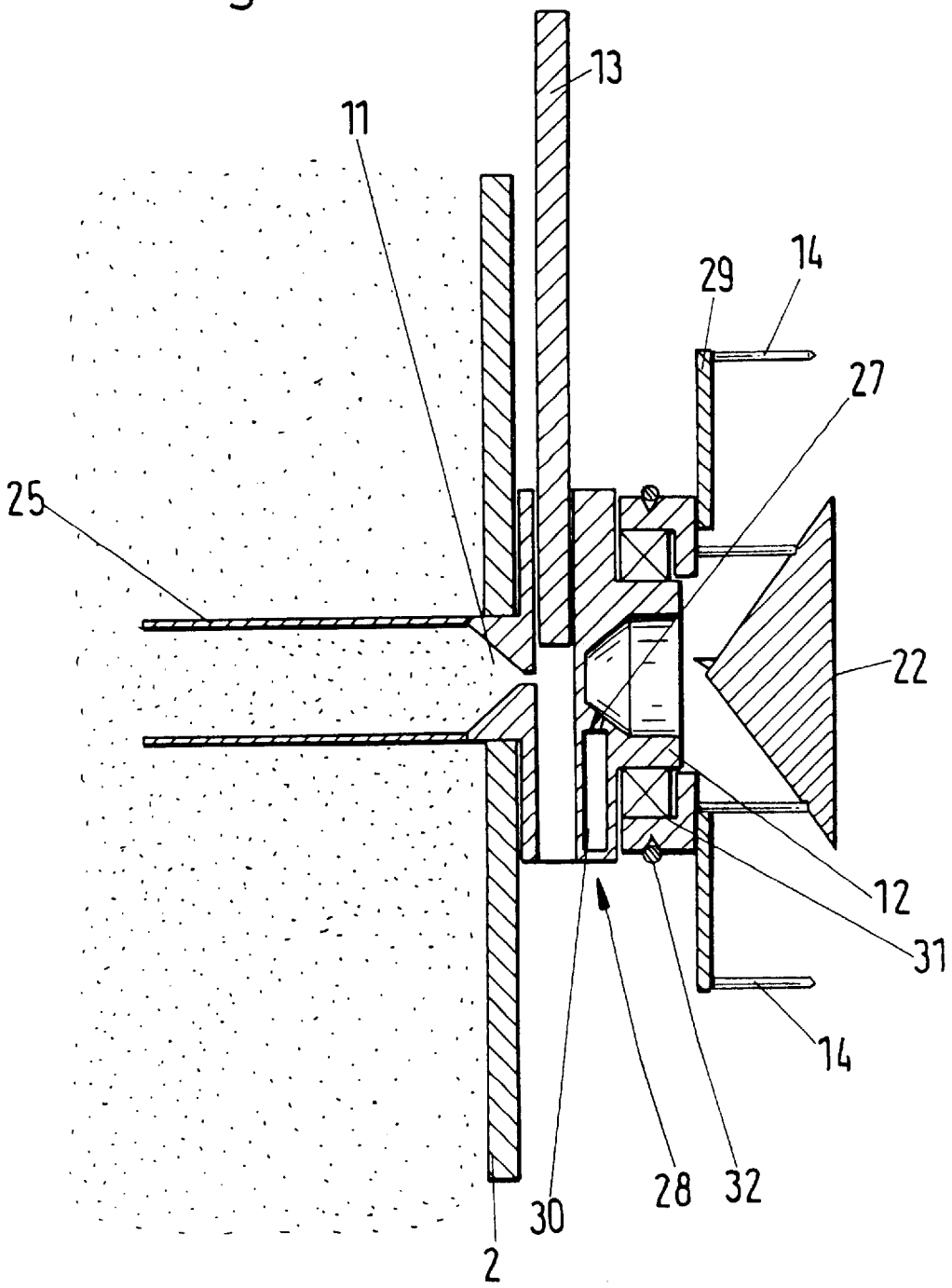
FIG. 12 is a view similar to FIGS. 10 and 11 of a spraying apparatus with a rotating baffle body and rotating electrodes.
Figure 13:
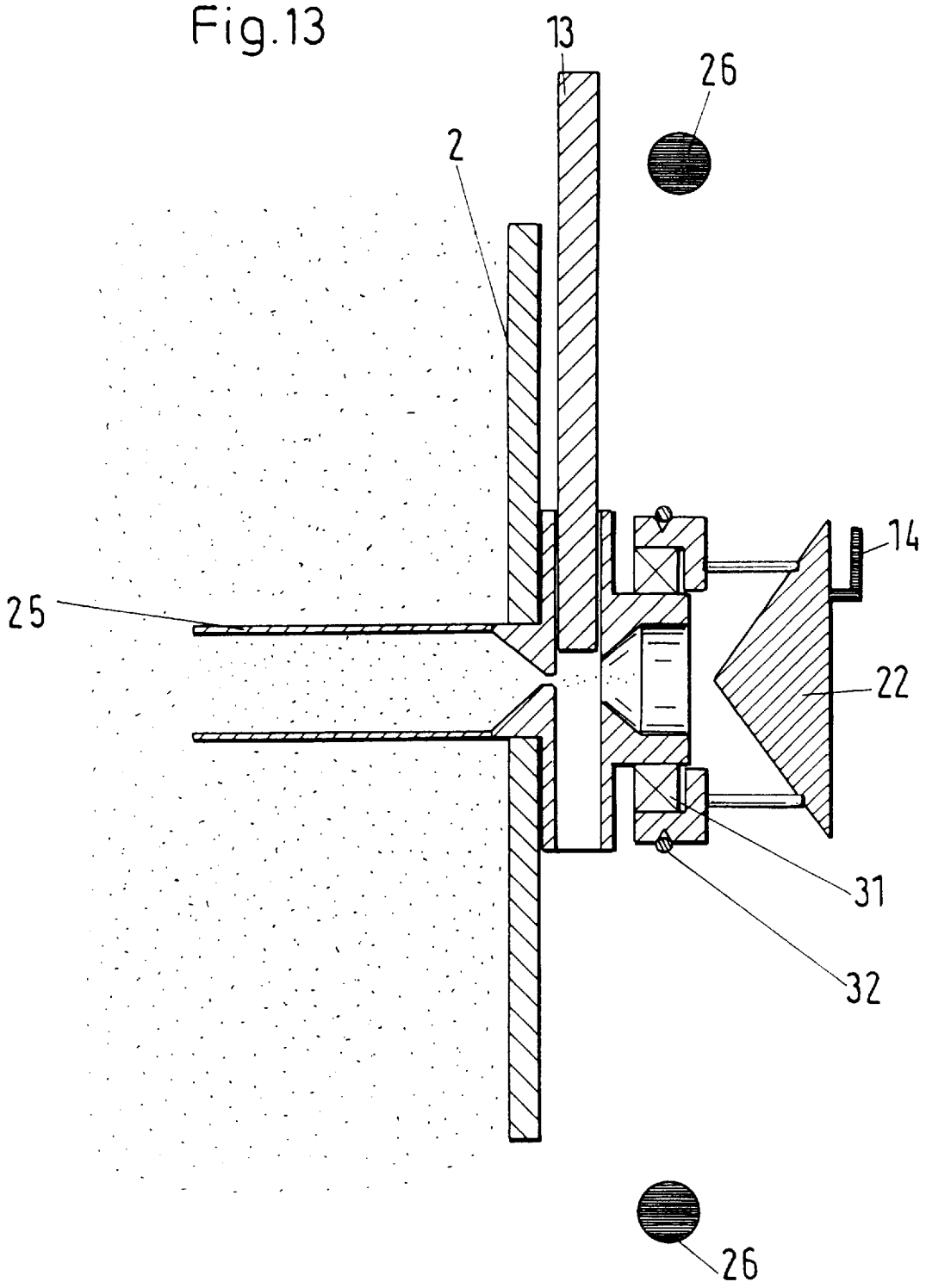
FIG. 13 is another view similar to FIGS. 10, 11 and 12 of a configuration with an annular electrode.

FIGS. 12 to 13 show further possibilities for the structure of the powder outlet region.

FIG. 12 shows a configuration in which both a rotating baffle body 22 and rotating high-voltage electrodes 14 on a rotating disc 29 are present. The rotatable configuration of the components 22, 14 is indicated by the ball bearing 31 and the drive belt 32.

Moreover, FIG. 12 shows an additional-air duct 30, through which additional air 28 can be supplied and can emerge through air nozzles 27 in the powder outlet region 12. Additional acceleration of the powder particles and formation of the powder cloud can be achieved through the use of the additional air 28.

FIG. 13 shows a configuration of a, for example, annular earth or ground electrode 26 in the region between a wall of the container 2 and the baffle body 22. At least some of the ion current flows to the earth electrode 26, with the result that the powder stream is intersected and improved charging is achieved. In this case, the high-voltage electrodes 14 are attached to the rotating baffle body 22. In this configuration, at least some of the ion current flows from the high-voltage electrode to the earth electrode and the powder particles are forced to intersect this ion current, with the result that better charging is achieved.

We claim:

1. A method for spraying a fluidized powder, which comprises:

a) introducing compressed air into a first chamber of a two-chamber fluidizing container, the container being closed except for a nozzle, an air inlet and an air outlet;

b) introducing powder through a closable powder feed orifice into a second chamber;

c) feeding the compressed air from the first chamber through a frit into the second chamber of the two-chamber fluidizing container forming a fluidized powder bed having a given air pressure;

d) maintaining suitable pressure conditions of the given air pressure in the second chamber by regulating valves in the air inlet and outlet;

e) extracting the fluidized powder from the vicinity of the fluidized bed and feeding the fluidized powder to the nozzle, controlling the extracting step by regulating the given air pressure; and f) electrically charging the fluidized powder emerging from the two-chamber container through the nozzle.

2. An apparatus for spraying a fluidized powder, comprising:

a) a closed container having a first chamber for receiving compressed air, a second chamber, and a frit disposed between said chambers for passing the compressed air out of said first chamber and into said second chamber for providing said second chamber with a given air pressure;

b) a regulator for compressed air supply and discharge for controlling said given air pressure;

c) a closable powder feed orifice for introducing powder into said second chamber where the powder is fluidized into a fluidized bed by the compressed air from said first chamber;

d) a powder outlet region and a closable nozzle at said powder outlet region for receiving the fluidized powder to be extracted from the vicinity of the fluidized bed, a flow rate of the powder being dependent on said given air pressure; and e) high-voltage electrodes for charging the powder at said powder outlet region.

3. The apparatus according to claim 2, including air nozzles opening into said powder outlet region for conducting additional air, for additionally accelerating particles of the powder and for additionally forming a powder cloud.

4. The apparatus according to claim 2, including a baffle body disposed in said powder outlet region.

5. The apparatus according to claim 4, including a drive device for rotating said baffle body.

6. The apparatus according to claim 2, including a rotating disc on which said high-voltage electrodes for electrostatic charging are disposed for achieving particularly uniform charging at a circumference of a powder cloud.

7. The apparatus according to claim 2, wherein said container has a housing wall, and including a pipe for extracting the fluidized powder from the fluidized bed, for conducting the fluidized powder to said nozzle and for preventing relatively large air bubbles rising on said housing wall from reaching said nozzle.

* * * * *